US006425489B1

(12) United States Patent
Cunningham

(10) Patent No.: US 6,425,489 B1
(45) Date of Patent: Jul. 30, 2002

(54) TOOL HOLDER

(75) Inventor: Earl T. Cunningham, Glenview, IL (US)

(73) Assignee: Eklind Tool Company, Franklin Park, IL (US)

( * ) Notice: Subject to any disclaimer, the term of this patent is extended or adjusted under 35 U.S.C. 154(b) by 0 days.

(21) Appl. No.: 09/795,561

(22) Filed: Feb. 28, 2001

(51) Int. Cl.[7] ..... A47F 7/00
(52) U.S. Cl. ..... 211/70.6
(58) Field of Search ..... 211/70.6, 69, 69.1; 206/377, 379

(56) References Cited

U.S. PATENT DOCUMENTS

| | | | | |
|---|---|---|---|---|
| 1,362,012 | A | * | 12/1920 | Koranek |
| D155,024 | S | * | 8/1949 | Mozneck |
| D169,077 | S | * | 3/1953 | Mains, Jr. |
| 3,179,255 | A | * | 4/1965 | De'Caccia |
| 3,727,771 | A | * | 4/1973 | Hoffman |
| 3,997,053 | A | | 12/1976 | Bondhus |
| 4,412,618 | A | * | 11/1983 | LaConte |
| D373,943 | S | | 9/1996 | Fuhrmann |
| 5,791,839 | A | | 8/1998 | Budert |
| 5,938,028 | A | | 8/1999 | Hu |
| 6,279,743 | B1 | * | 8/2001 | Ballard et al. |

* cited by examiner

*Primary Examiner*—Alvin Chin-Shue
*Assistant Examiner*—Sarah Purol
(74) *Attorney, Agent, or Firm*—Cook, Alex, McFarron, Manzo, Cummings & Mehler, Ltd.

(57) ABSTRACT

A tool stand having a one-piece body with a cavity, the cavity having an opening defined by two side walls, a bottom and a back. A cover is secured to the body and sized to close the cavity. In the preferred embodiment, the cover slopes downwardly from the back toward the bottom of the body. The cover has at least two rows of apertures, with the apertures being sized and shaped to receive the shanks of the tools to be stored in the holder. The body includes at least one divider integral therewith that is disposed in the cavity substantially perpendicular to the cover so as to form a divider between the first and second rows of apertures. This divider prevents the shanks of any tools held in one row of apertures from interfering with the shanks of any tools held in the other row of apertures. The tool holder may include either, or both, vertical and horizontal flanges for securing the holder to vertical or horizontal surfaces. The side walls may also include an aperture and projecting stud that are sized and spaced so that the stud on one side wall mates with an aperture or the side wall of an adjacent tool holder, so as to interlock two similar tool holders.

8 Claims, 6 Drawing Sheets

TOOL HOLDER

The present invention relates to a tool stand for holding a set of shanked tools of various and graduated sizes.

BACKGROUND OF THE INVENTION

Many mechanics, and especially professional mechanics, require sets of tools of graduated sizes in order to perform their regular tasks. This is particularly true with tools such as wrenches, drills, screw drivers, and the like.

A continuing problem for users of such tools is how to store them. Specifically, storage must permit easy access to the tool when it is removed and/or replaced from storage. Equally important is that the method of storage must permit for easy identification of the size of the tool so that the user can expeditiously select the proper size for the job at hand. It is also desirable that the storage permits the tools to be conveniently located near the job site.

Accordingly, it is the principle object of the present invention to provide a tool stand or holder for storing a set of shanked tools of graduated sizes that provides easy access to the tools for removal from and replacement in the stand.

It is a further object to provide such a tool stand that permits easy visual identification of the size of the tool.

It is an additional object to provide a tool holder that is easily mounted to a stationary object.

It is also an object to provide a tool stand that is adapted to form an array with other similar tool stands that are configured to hold the other sets of tools that the mechanic may have.

SUMMARY OF THE INVENTION

These objects, and others that will become apparent upon reference to the attached drawings and following detailed description are provided by a tool stand having a one-piece body with a cavity, the cavity having an opening defined by two side walls, a bottom and a back. A cover is secured to the body and sized to close the cavity. In the preferred embodiment, the cover slopes downwardly from the back toward the bottom of the body. The cover has at least two rows of apertures, with the apertures being sized and shaped to receive the shanks of the tools to be stored in the holder. The body includes at least one divider integral therewith that is disposed in the cavity substantially perpendicular to the cover so as to form a divider between the first and second rows of apertures. This divider prevents the shanks of any tools held in one row of apertures from interfering with the shanks of any tools held in the other row of apertures.

In keeping with a further aspect of the invention, the tool holder may include either, or both, vertical and horizontal flanges for securing the holder to vertical or horizontal surfaces.

The side walls may also include an aperture and projecting stud that are sized and spaced so that the stud on one side wall mates with an aperture or the side wall of an adjacent tool holder, so as to interlock two similar tool holders.

DETAILED DESCRIPTION OF THE PREFERRED EMBODIMENT

Figure 1:
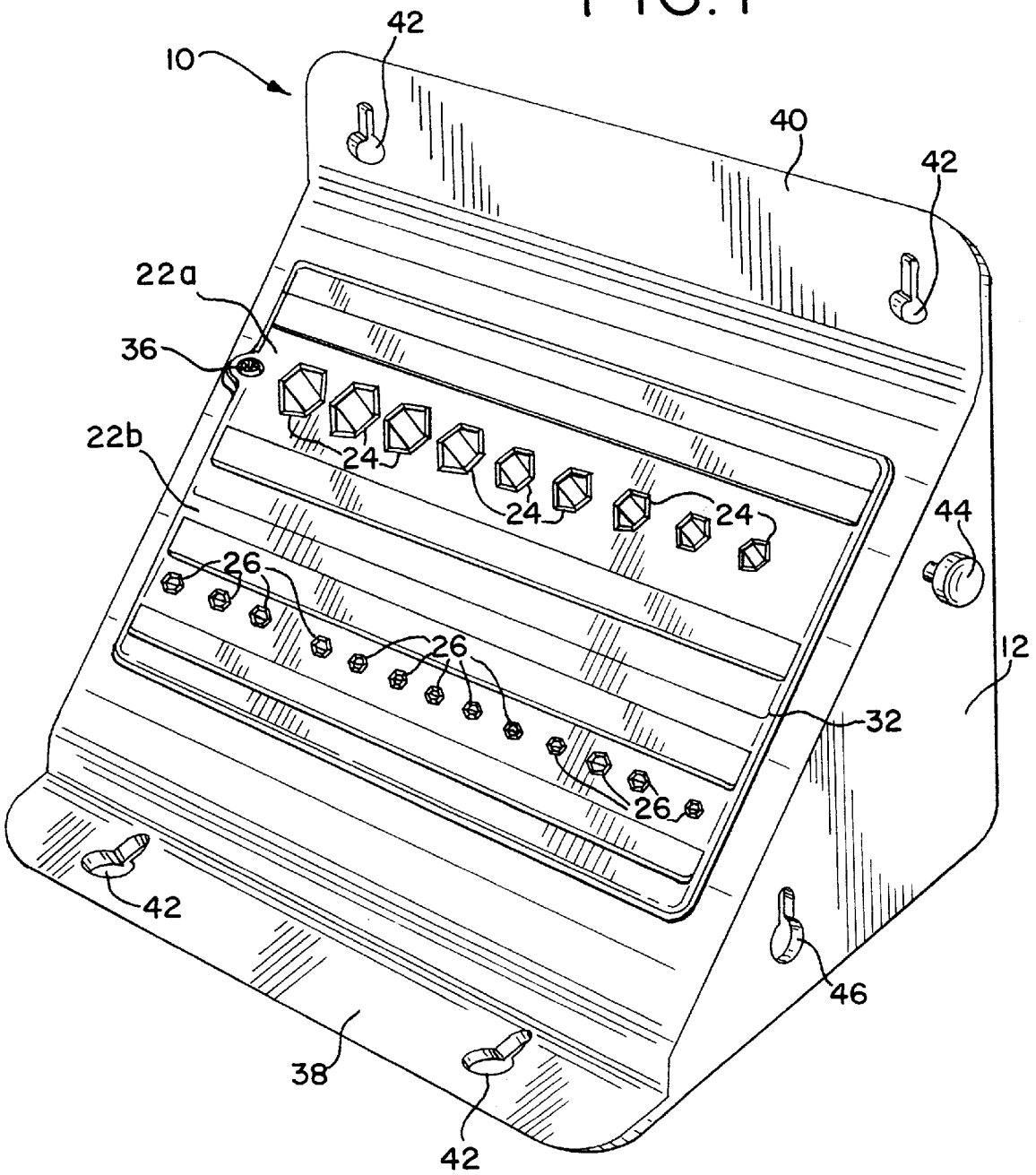
FIG. 1 is a perspective view of a tool holder according to the present invention.
Figure 2:
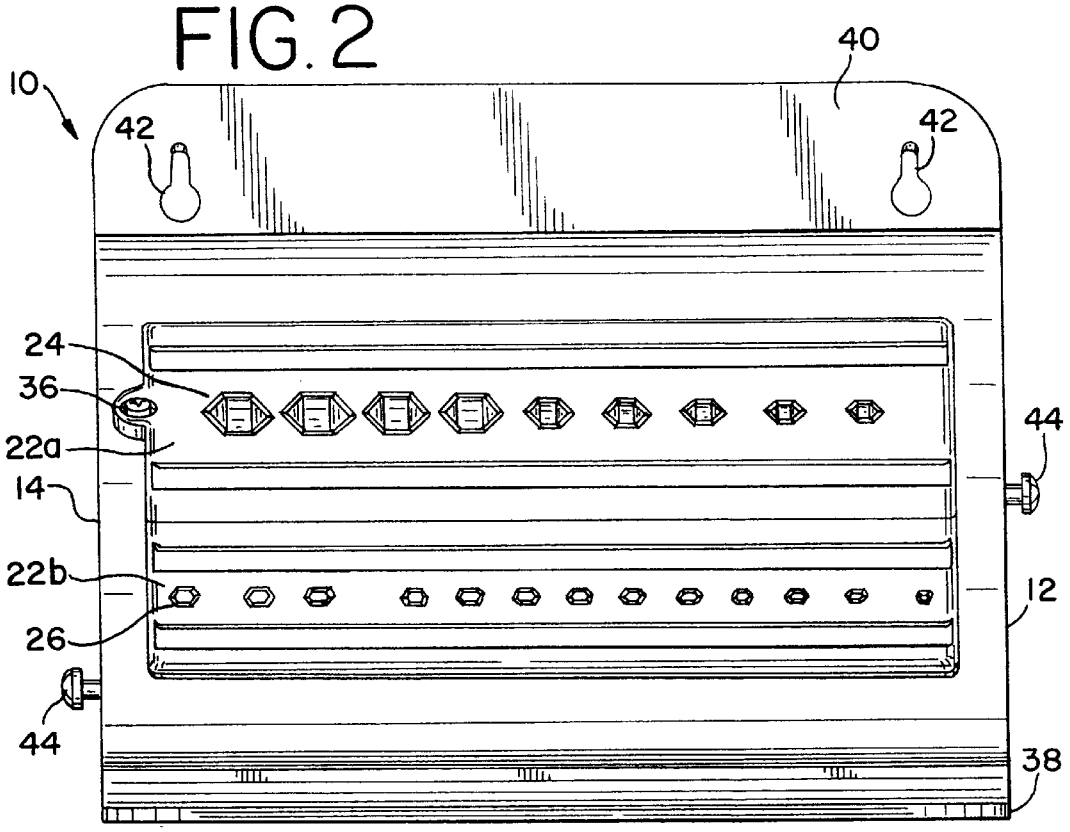
FIG. 2 is a front view of the tool holder of FIG. 1.

Turning to the figures of the drawing, there is seen a tool holder, generally indicated by 10, according to the present invention. While the tool holder is shown in the context of one suited for storing tools with hexagonal shafts, such as hex wrenches, the invention is equally well suited for holding sets of other types of shanked tools, such as drill bits, screw drivers, nut drivers, and the like.

Returning to the drawings, the tool holder 10 includes a base comprising side walls 12 and 14, a bottom 16 and a back 18, together which define a cavity 20.

The opening of the cavity is closed by a cover 22 that includes two rows 24 and 26 of hex-shaped apertures of graduated size for receiving the shanks of the hex wrenches to be held in the tool holder 10. The entrances to the apertures are beveled so as to facilitate the replacement of tools into the apertures even if the shanks of the tools are not precisely aligned with the aperture. Below each aperture there is space on the cover for placing an alpha-numeric designation for the tool to be held in the aperture.

In keeping with the invention, the cavity includes at least one divider or web 28 substantially perpendicular to the cover and which bisects the two rows of apertures 24 and 26. This divider 28 serves to separate the shanks of the tools held in one row from those held in another.

The cover 22 also includes bosses 30 projecting from the underside of the cover into the cavity. These bosses 30 serve to further guide the tools into the holder. As illustrated, all the bosses 30 for each row of apertures are connected to each other.

Figure 3:
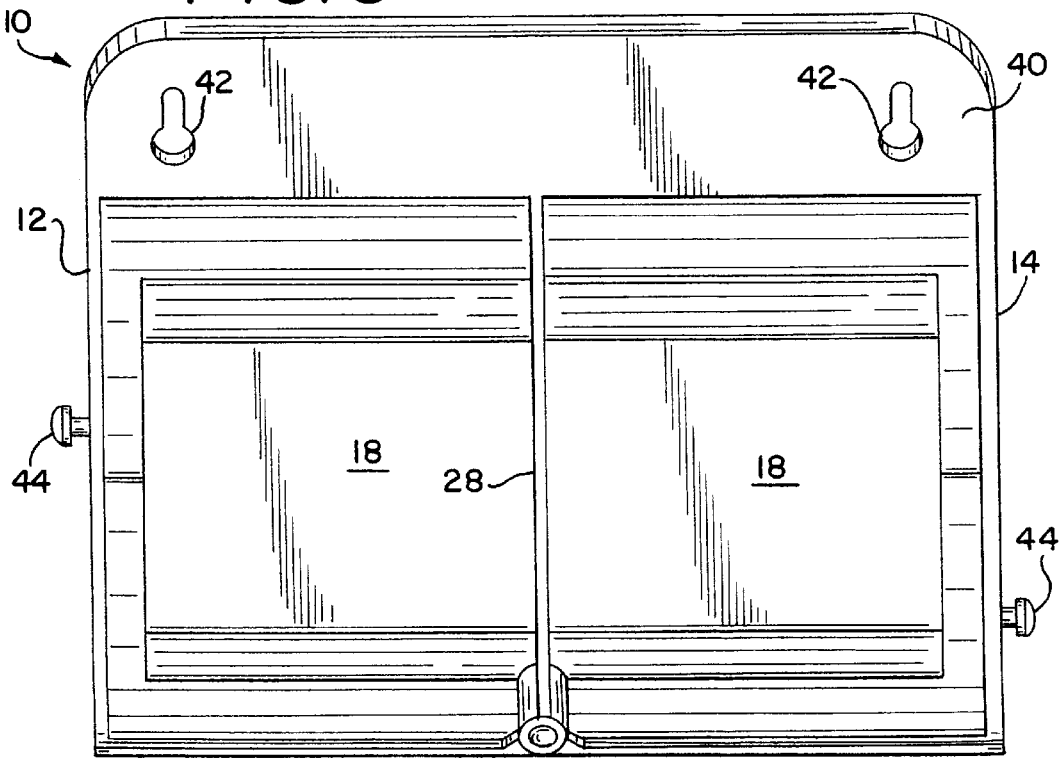
FIG. 3 is a back view of the tool holder of FIG. 1.
Figure 4:
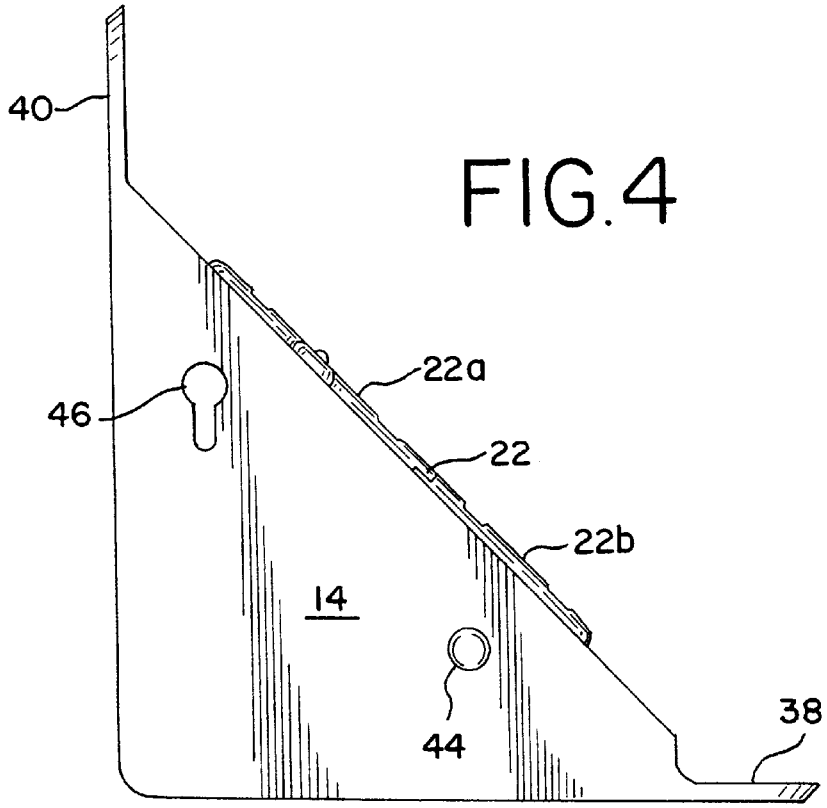
FIG. 4 is a left-side view of the tool holder of FIG. 1.
Figure 5:
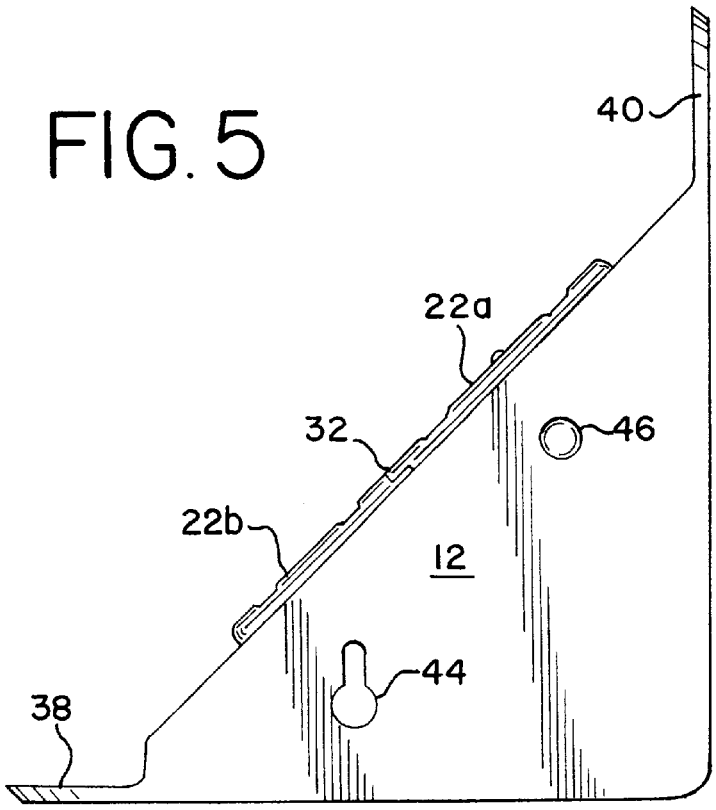
FIG. 5 is a right-side view of the tool holder of FIG. 1.
Figure 6:
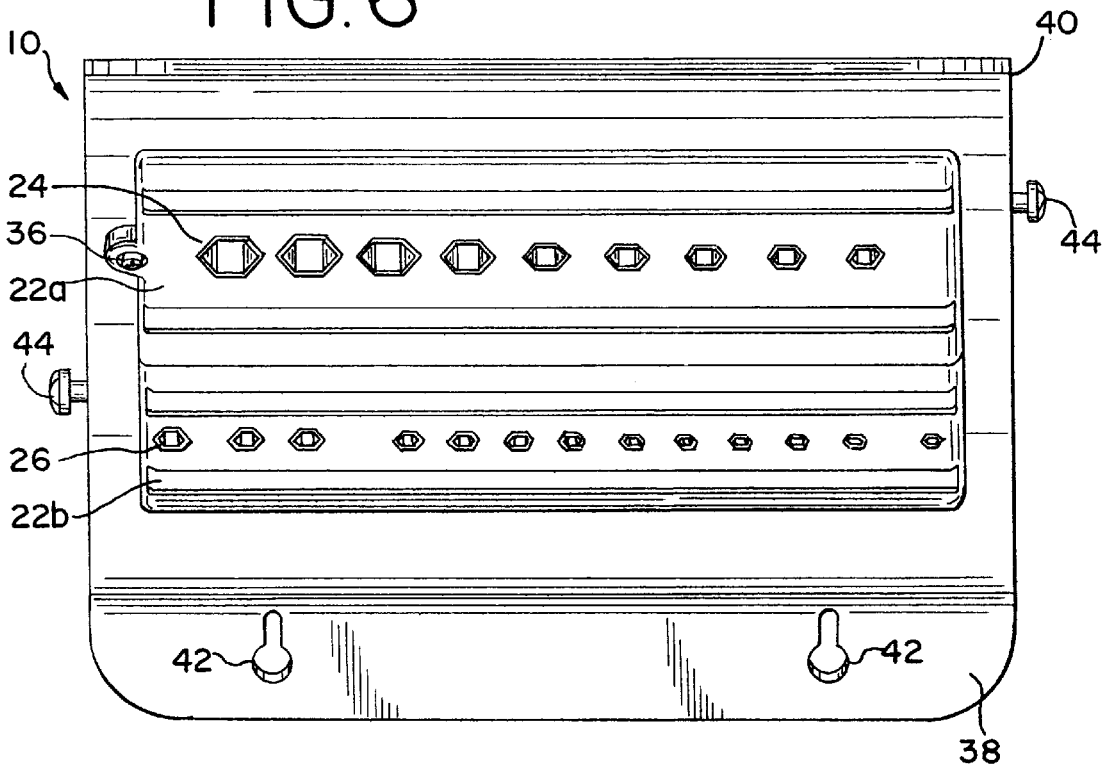
FIG. 6 is a top view of the tool holder of FIG. 1.
Figure 7:
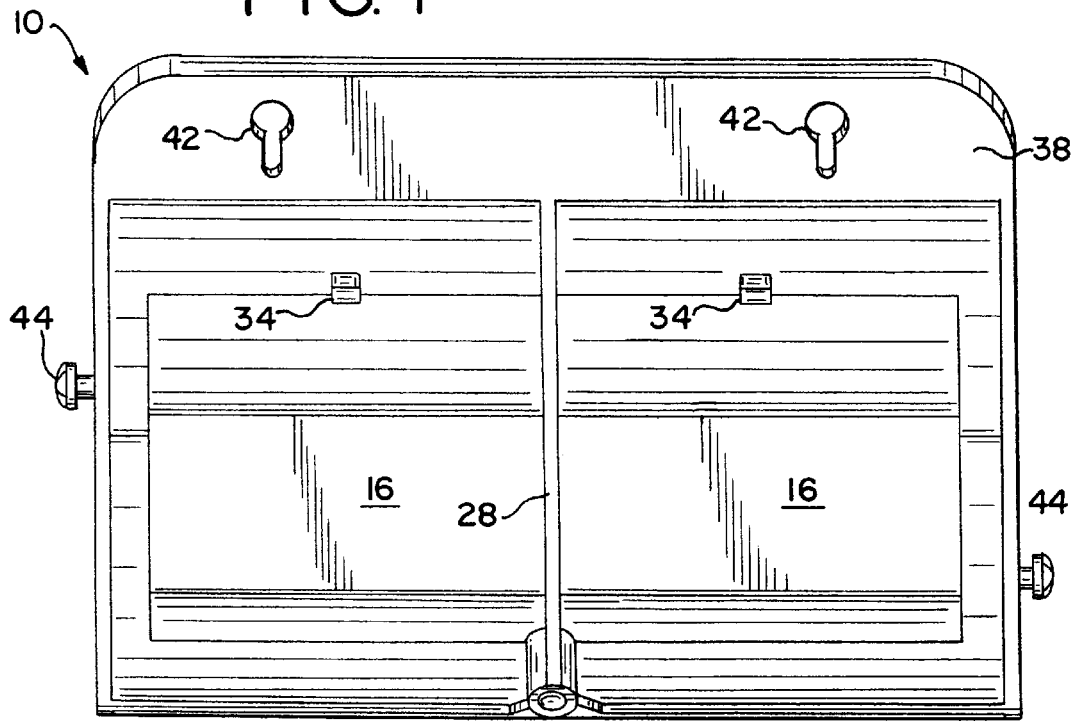
FIG. 7 is a bottom view of the tool holder of FIG. 1.
Figure 8:
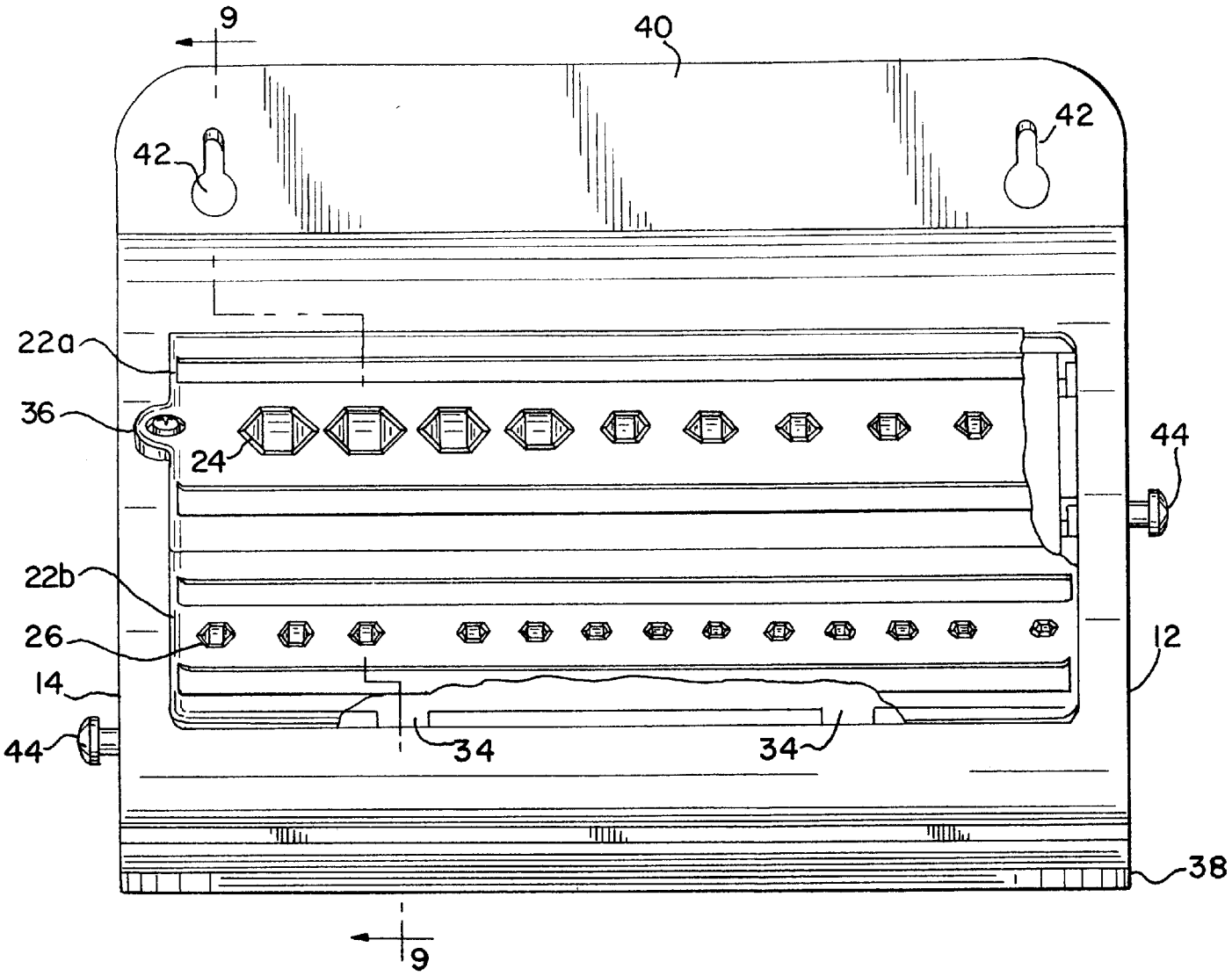
FIG. 8 is a front view of the tool holder of FIG. 1, with portions broken away to show detail.
Figure 9:
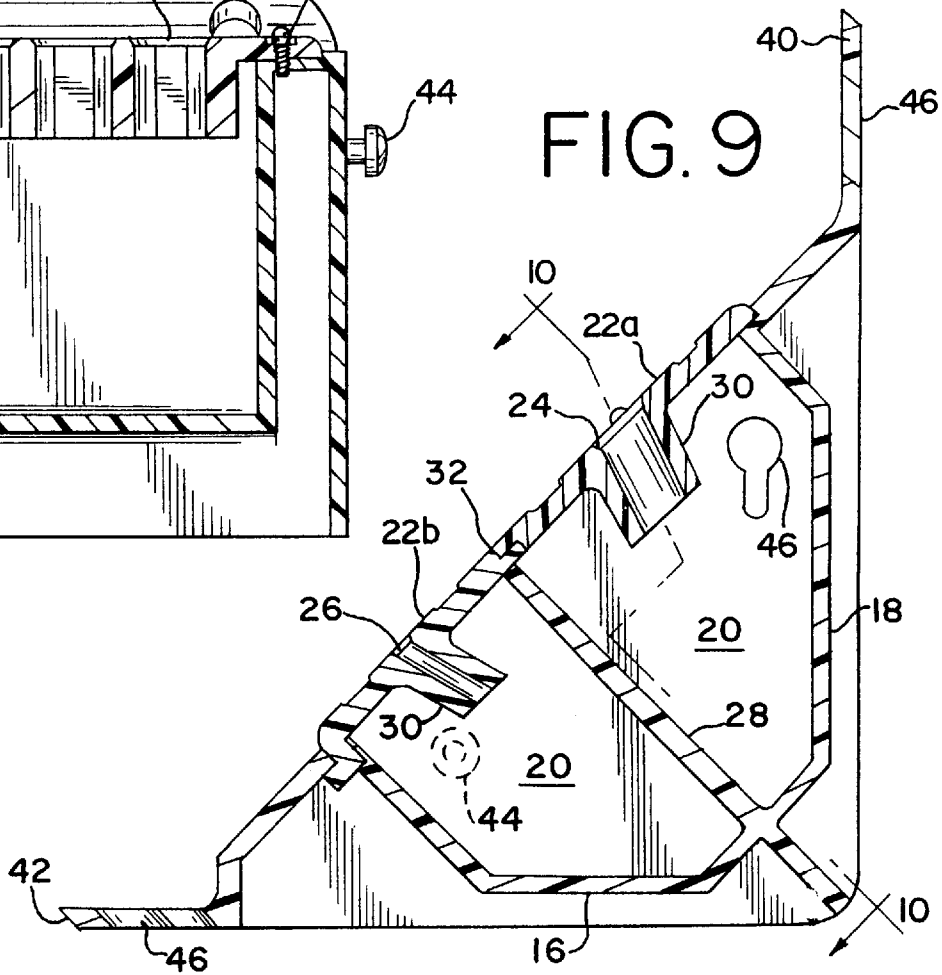
FIG. 9 is a cross-sectional view of the tool holder taken along line 9—9 of FIG. 8.
Figure 10:
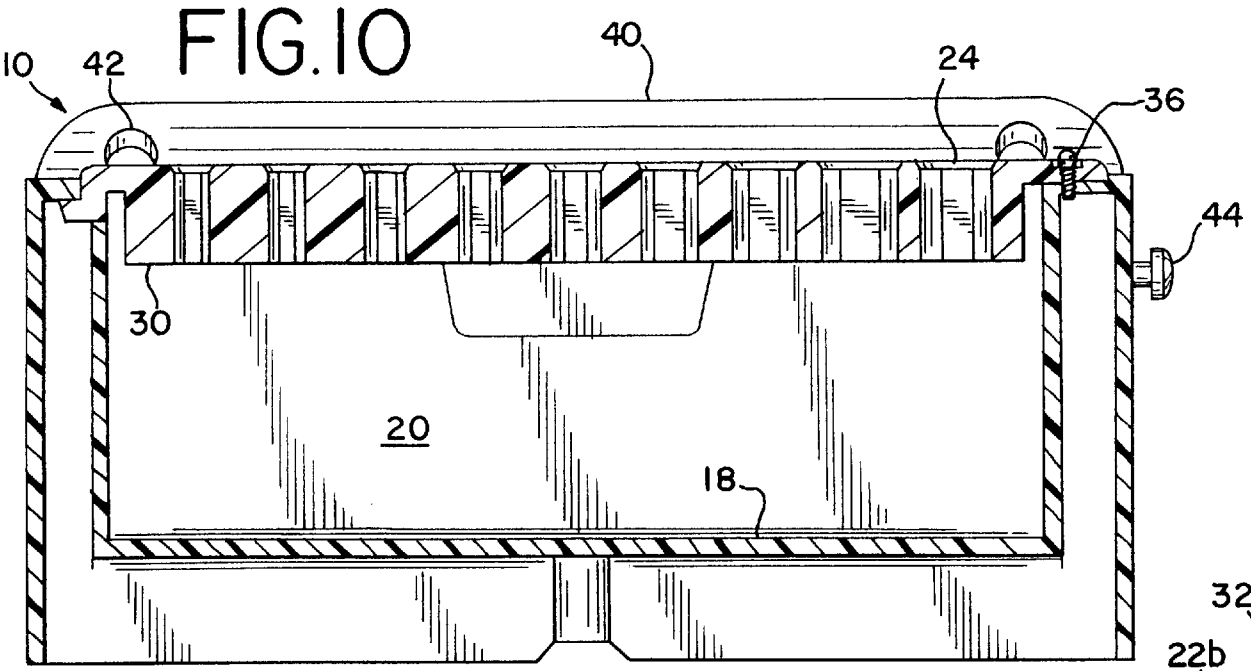
FIG. 10 is a cross-sectional view of the tool holder taken along line 10—10 of FIG. 9.

As best seen in FIG. 3, the axes of the bosses of the two rows of apertures are not perpendicular with respect to the cover, but are skewed towards each other. This permits the handles (or other portion of the tool which is to be grasped) of the tools in one row to be further separated from those in the other row. This helps to further prevent any interference between the handles of the tools in the two rows, making removal from or insertion into the tool holder easier.

As illustrated, the cover is also made of two pieces 22*a*, 22*b* that come together in a lap joint 32 that overlies the divider. The covers 22*a*, 22*b* may have tabs such as those at 34 for mating with apertures in the cavity, and may be further held in place by means of a screw, such as that designated by 36. As is readily appreciated, the same base configuration may be employed with covers configured for various types of shanked tools.

In keeping with a further aspect of the invention, the tool holder 10 includes horizontal and vertical flanges 38, 40 for securing the tool holder to, either a horizontal or vertical surface. To facilitate such mounting, each flange 38, 40 includes a pair of apertures 42 with an enlarged portion sized to receive the head of a screw or bolt and a narrow portion for receiving the shaft of the screw or bolt. Consequently, the flange can be located over a pair of screws already in place and then the tool holder slid so that the heads of the screws overlie the narrow portions of the aperture. Thus, the tool holder 10 can be easily removably mounted from screws that have been prelocated.

In keeping with a further aspect of the invention, means are provided for permitting the tool holder 10 to be mounted in an array with similar tool holders. To this end, each side wall includes a projecting stud 44 and an aperture 46 sized to receive the stud 44, so that the head of the stud 44 fits through the aperture 46 and then slides down into a narrower portion of the aperture 46. The stud and aperture are reversed in their location from one side wall 12 to the other side wall 14 so that when two tool holders are placed side wall-to-side wall with their openings facing in the same direction, the stud on one side wall mates with a hole on the other side wall.

In practice, it is contemplated that the body and cover of the tool holder will be made by injection molding, although other materials and techniques may be appropriate.

Thus, a tool holder has been provided which accomplishes all the objects of the present invention. While the invention has been described in terms of its preferred embodiment, there is no intent to limit it to the same. Instead, the invention is to be defined by the following claims.

What is claimed:

1. A tool stand for storing a plurality of shanked tools comprising:

a one-piece body having a cavity with an opening defined by first and second side walls, a bottom, and a back;

a cover secured to the body and sized to close the cavity, the cover having at least first and second rows of apertures, the apertures being sized and shaped to receive the shanks of the tools to be stored in the holder;

at least one divider integral with the body disposed in the cavity substantially perpendicular to the cover and between the first and second rows of apertures so as to form a barrier between the shanks of any tools held in the first row of apertures from the shanks of any tools held in the second row of apertures; and each side wall having an aperture and a projecting stud sized and spaced so as to permit the tool holder to interlock with the side wall of an adjacent tool holder of identical configuration.

2. The tool holder of claim 1 wherein the body includes a vertical flange for securing the holder to a vertical surface.

3. The tool holder of claim 1 wherein the body includes a horizontal flange for securing the holder to a horizontal surface.

4. The tool holder of claim 1 wherein the cover is secured to the base by a screw.

5. The tool holder of claim 1 wherein the cover includes a designation of the tool size adjacent the aperture sized to hold a tool of such size.

6. The tool holder of claim 1 wherein the apertures have bosses projecting from the cover into the interior of the cavity.

7. The tool holder of claim 6 wherein the bosses have axes, the axes of the bosses for each row of apertures being aligned, and with the axes of the bosses of the first row of apertures being skewed toward the axes of the bosses of the second row of apertures.

8. The tool holder of claim 1 wherein the cover comprises two pieces joined together by a lap joint.

* * * * *